US006786053B2

(12) United States Patent
Drube

(10) Patent No.: US 6,786,053 B2
(45) Date of Patent: Sep. 7, 2004

(54) PRESSURE POD CRYOGENIC FLUID EXPANDER

(75) Inventor: Paul Drube, Burnsville, MN (US)

(73) Assignee: Chart Inc., Burnsville, MN (US)

( * ) Notice: Subject to any disclaimer, the term of this patent is extended or adjusted under 35 U.S.C. 154(b) by 0 days.

(21) Appl. No.: 10/251,034

(22) Filed: Sep. 20, 2002

(65) Prior Publication Data

US 2004/0055315 A1 Mar. 25, 2004

(51) Int. Cl.[7] ..... F17C 9/02
(52) U.S. Cl. ..... 62/50.2; 62/50.4
(58) Field of Search ..... 62/45.1, 50.1, 62/50.2, 50.4

(56) References Cited

U.S. PATENT DOCUMENTS

| | | | |
|---|---|---|---|
| 2,040,059 | A | 5/1936 | Mesinger |
| 2,489,514 | A | 11/1949 | Benz |
| 4,175,395 | A | 11/1979 | Prost et al. |
| 4,947,651 | A | 8/1990 | Neeser et al. |
| 5,136,852 | A | 8/1992 | Neeser et al. |
| 5,390,500 | A | 2/1995 | White et al. |
| 5,421,160 | A | 6/1995 | Gustafson et al. |
| 5,537,824 | A | 7/1996 | Gustafson et al. |
| RE35,874 | E | 8/1998 | Neeser et al. |
| 5,924,291 | A | 7/1999 | Weiler et al. |
| 5,937,655 | A | 8/1999 | Weiler et al. |
| 6,044,647 | A | 4/2000 | Drube et al. |

*Primary Examiner*—Cheryl J. Tyler
*Assistant Examiner*—Malik N. Drake
(74) *Attorney, Agent, or Firm*—Piper Rudnick LLP

(57) ABSTRACT

A system that generates high pressure cryogenic gas includes a storage tank that contains a liquid cryogen and a feed line that supplies the liquid cryogen to a pressure pod. The pressure in the pressure pod gradually increases due to ambient heat to a first predetermined level. A regulator valve opens at the first predetermined level thereby directing the liquid cryogen to a heat exchanger where it is vaporized and directed back to the pressure pod to raise the pressure therein further. Once the pressure in the pressure pod reaches a second predetermined level, a dispense valve opens. The pressurized liquid cryogen is directed through the dispense valve to a vaporizer that vaporizes the high pressure liquid cryogen to a cryogenic gas that may be dispensed and stored in a tank.

20 Claims, 2 Drawing Sheets

PRESSURE POD CRYOGENIC FLUID EXPANDER

TECHNICAL FIELD OF THE INVENTION

The present invention relates in general to systems for producing cryogenic gases, and more particularly, to a system for converting liquid cryogen into a high pressurized gas and for storing and dispensing the resulting pressurized cryogenic gas.

BACKGROUND OF THE INVENTION

Cryogenic gases are used in a variety of industrial and medical applications. Such cryogens are typically stored as liquids in vessels, however, because one volume of liquid produces many volumes of gas (600–900 volumes of gas per one volume of liquid) when the liquid is permitted to vaporize/boil and warm to ambient temperature. To store an equivalent amount of gas requires that the gas be stored at very high pressure. This would require heavier and larger tanks and expensive pumps or compressors.

Many industrial applications require that the cryogen be supplied as a high pressure gas, such as in the range of 350 psig to 450 psig. For example, high pressure nitrogen and argon gases are required for laser welding while high pressure nitrogen, oxygen and argon gases are required for laser cutting. In addition, in some industries, it is desirable for a system to provide both liquid cryogen as well as high pressure cryogenic gas.

It is known to use compressors or pumps to pressurize cryogenic gases or liquids, respectively. In the latter case, the pressurized liquid may be directed to a vaporizer that uses ambient heat to provide cryogenic gas at high pressure. Such approaches, however, suffer from the disadvantages associated with using a compressor or pump. These disadvantages include high initial and replacement costs and service or maintenance requirements.

Alternatively, prior art cryogenic gas delivery systems that direct cryogenic liquid from a bulk tank into a smaller tank for pressurizing, so that the pressurized liquid may be forced to a vaporizer to produce vaporized gas, are known. Such systems are illustrated in U.S. Pat. No. 2,040,059 to Mesinger, U.S. Pat. No. 4,175,395 to Prost et al. and U.S. Pat. No. 5,924,291 to Weiler et al. As illustrated by the Mesinger '059 patent and the Weiler '291 patent, it is also known to build the pressure in the smaller pressure building tank by use of a pressure building circuit that receives liquid from the tank, vaporizes it using ambient heat via a vaporizer and returns the resulting gas to the head space of the tank. In contrast, the Prost et al. '395 patent builds the pressure within the smaller tank by the transfer of ambient heat through the smaller pressure building tank wall.

While these systems are effective, the system of the Weiler et al. '291 is somewhat complex. In addition, the systems of the Mesinger '059 and the Prost et al. '395 patents are limited in the gas pressure levels that may be obtained and provided. Also, none of the systems provide both gas and liquid and none feature a modular construction for ease of retrofitting existing cryogenic liquid dispensing systems.

Accordingly, it is an object of the present invention to provide a system that builds the pressure of a liquid cryogen to convert the liquid cryogen to a cryogenic gas at a high pressure.

It is another object of the invention to provide a system that increases the pressure of the liquid cryogen by using ambient heat.

It is another object of the invention to provide a system that dispenses both liquid cryogen and high pressure cryogen gas.

It is another object of the invention to provide a system for pressurizing the cryogenic liquid and converting it into high pressure cryogen gas that is modular so that existing liquid dispensing systems may be retrofitted with the gas generating module.

It is still another object of the invention to provide a system that builds the pressure of a liquid or gas cryogen without pumps or compressors.

SUMMARY OF THE INVENTION

The invention is a system for converting a liquid cryogen into a high pressure cryogenic gas. The system includes a storage vessel or tank full of liquid cryogen that is in communication with a feed line. The feed line is in communication with a pressure pod. Liquid cryogen is transferred from the storage vessel via the feed line to the pressure pod. Cryogenic liquid in the pressure pod is warmed and vaporized by ambient heat so as to increase the pressure therein. Once the pressure in the insulated tank reaches a first predetermined level, a regulator valve opens allowing the liquid cryogen to travel to a heat exchanger. The heat exchanger receives the liquid cryogen and vaporizes it. The resulting vapor is directed back to the pressure pod thereby further increasing the pressure of the liquid cryogen therein. Once the pressure in the insulated tank reaches a second predetermined level that is higher than that of the first predetermined level, a dispense valve opens.

Once the dispense valve opens, the pressurized liquid cryogen is directed to a vaporizer. The vaporizer converts the liquid cryogen into a cryogenic gas for dispensing and storage. Alternatively, the dispense valve may be set to open when all of the liquid cryogen in the pressure pod has been converted to cryogenic gas which may then be dispensed or stored.

For a more complete understanding of the nature and scope of the invention, reference may now be had to the following detailed description of embodiments thereof taken in conjunction with the appended claims and accompanying drawings.

BRIEF DESCRIPTION OF THE DRAWINGS

Further aspects of the invention and their advantages may be discerned from the following description when taken in conjunction with the drawings, in which like characters number like parts and in which.

DETAILED DESCRIPTION OF THE PREFERRED EMBODIMENTS

Figure 1:
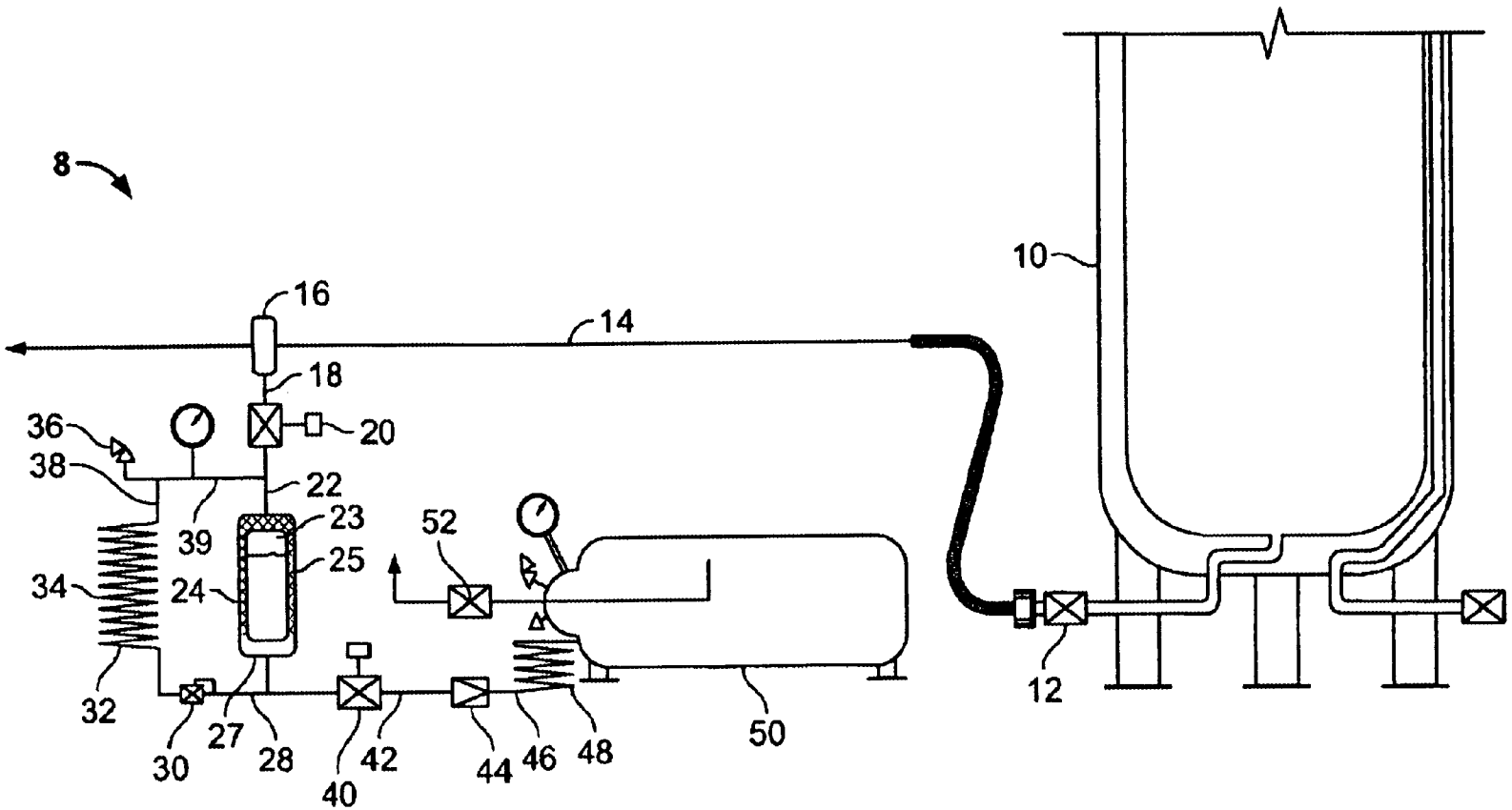
FIG. 1 is a schematic diagram of an embodiment of the pressure pod cryogenic fluid expander system of the present invention.

FIG. 1 is a schematic diagram of an embodiment of the pressure pod cryogenic fluid expander system of the present invention, indicated in general at 8. The system coverts liquid cryogen into a pressurized gas and then stores and dispenses the pressurized gas. The system includes two stages of pressurization or pressure building of the liquid cryogen to convert the liquid cryogen into a cryogenic gas at a high pressure for storage and dispensing. The system may be constructed/configured as a module and used to retrofit existing cryogenic liquid dispensing systems.

A storage vessel or tank 10 filled with a liquid cryogen, such as liquid nitrogen, at or near atmospheric pressure is connected to the system via line 14. A valve 12 controls the gravity flow of the liquid cryogen out of the tank 10 to the line 14. When valve 12 is open, liquid cryogen flows from the tank 10 through line 14 to a point of use (not shown). Line 14 also communicates with a condenser 16 to which line 18 is attached. The flow of liquid through line 18 is controlled by a feed valve 20.

During the initial stage of operation of the system 8 of FIG. 1, feed valve 20 is open so that liquid cryogen from line 14 flows through line 18, open feed valve 20 and line 22 to a pressure pod 24. The pressure pod 24 is a small tank with a head space 23. The pod 24 is surrounded with an insulating material 25, such as fiberglass or other insulating material known in the art. Alternatively, the pod may feature a jacketed construction so as to be vacuum insulated. The insulation 25 minimizes the amount of heat that enters the liquid cryogen in the pressure pod 24.

The liquid side 27 of the pressure pod 24 is in communication with line 28, which communicates with an automated valve 30, such as pressure building regulator or economizer, and a dispense valve 40, which also preferably is automated. When the feed valve 20 is open to allow the liquid cryogen into the pressure pod 24, the regulator valve 30 and the dispense valve 40 are closed. As a result, the liquid cryogen from line 14 collects in the pressure pod 24.

Initially, the pressure pod 24 is at the same pressure as the pressure of line 14. Once the pressure pod 24 is full, the feed valve 20 closes thereby trapping the liquid in the pressure pod 24. The pressure within the pressure pod 24 gradually increases due to the slow warming of the liquid cryogen therein by ambient heat traveling through insulation 25. Once the pressure in the pressure pod 24 increases to a first predetermined level, the regulator or economizer valve 30 opens. The first predetermined level is set at a pressure of approximately 20 to 30 psi above the highest operating pressure of the system gas storage tank, which will be described below.

The opened regulator valve 30 allows the liquid cryogen to travel to a pressure builder, such as a pressure building coil or heat exchanger 34. The liquid cryogen travels through line 28, regulator valve 30 and heat exchanger inlet 32 to the heat exchanger 34 where it is vaporized. The vaporized liquid cryogen is directed from the heat exchanger 34 through heat exchanger outlet 38 to the head space 23 of the pressure pod 24 through line 39. The introduction of the vaporized liquid cryogen into the head space 23 of the pressure pod 24 results in a rapid increase of the pressure within the pressure pod 24. The pressure is increased or built until it reaches a second predetermined level, preferably 50 psi higher than the storage or operating pressure within tank 50. Once the pressure within the pressure pod 24 reaches the second predetermined level, the dispense valve 40 opens.

As a result, the liquid cryogen from the pressure pod 24 is forced through the dispense valve 40, through line 42, dispense check valve 44, through line 46 to the vaporizer 48 at a high pressure. As the liquid cryogen flows through the vaporizer 48, the vaporizer 48 converts the liquid cryogen to a cryogenic gas. The cryogenic gas is delivered to the gas storage tank 50, which may have an operating pressure in the range of, for example, 350 psig to 450 psig. Higher pressures are possible. Pressures are only limited by component pressure ratings.

As the cryogenic gas is delivered to the tank 50, the pressure in the tank 50 increases. As a result, the pressure in the pressure pod 24 and the pressure in the tank 50 equalize at a pressure corresponding to the operating pressure of the gas storage tank 50. The capacity of the storage tank 50 and the pressure pod 24 are sized to allow time for the heat exchanger 34 to warm and supply gas to the head space of pressure pod 24 at the required pressure and flow. As a result, the cryogenic gas is continuously delivered to the tank 50 through the vaporizer 48 until approximately all of the liquid cryogen has drained out of the pressure pod 24. The tank 50 is in communication with a gas use valve 52 which may be manipulated to dispense the high pressure cryogenic gas to a point of use.

Once the pressure pod 24 is emptied, the dispense valve 40 closes and the feed valve 20 opens. The remaining pressurized cryogenic gas in the pod flows into the gas to liquid condenser 16 where it is liquefied. The gas to liquid condenser 16 reduces the pressure of the cryogenic gas from the pod so that it is equal to the pressure of the liquid cryogen leaving the liquid tank source 10 and in the flow stream line 14. The liquid cryogen in the gas to liquid condenser 16 joins the flow of liquid cryogen in line 14. This allows the high pressure gas remaining in the pressure pod 24 and the pressure building coil 34 to be released so that liquid cryogen may return to the pressure pod 24 to restart the expansion/pressurization cycle of the liquid cryogen. As a result, it is not necessary to vent the remaining cryogenic gas from the pressure building system before the cycle is repeated.

The regulator valve 30 closes when the pressure in the pod 24 drops below the first predetermined level described previously. As vapor travels out of pod 24 and into condenser 16, the pressure in the pod is reduced. Once the pressure in pod 24 and line 14 has been equalized, the pressure pod 24 begins to refill with the liquid cryogen. The liquid cryogen gradually fills the pressure pod until it is full. The above cycle than repeats to expand the liquid cryogen to a cryogenic gas at a high pressure.

Figure 2:
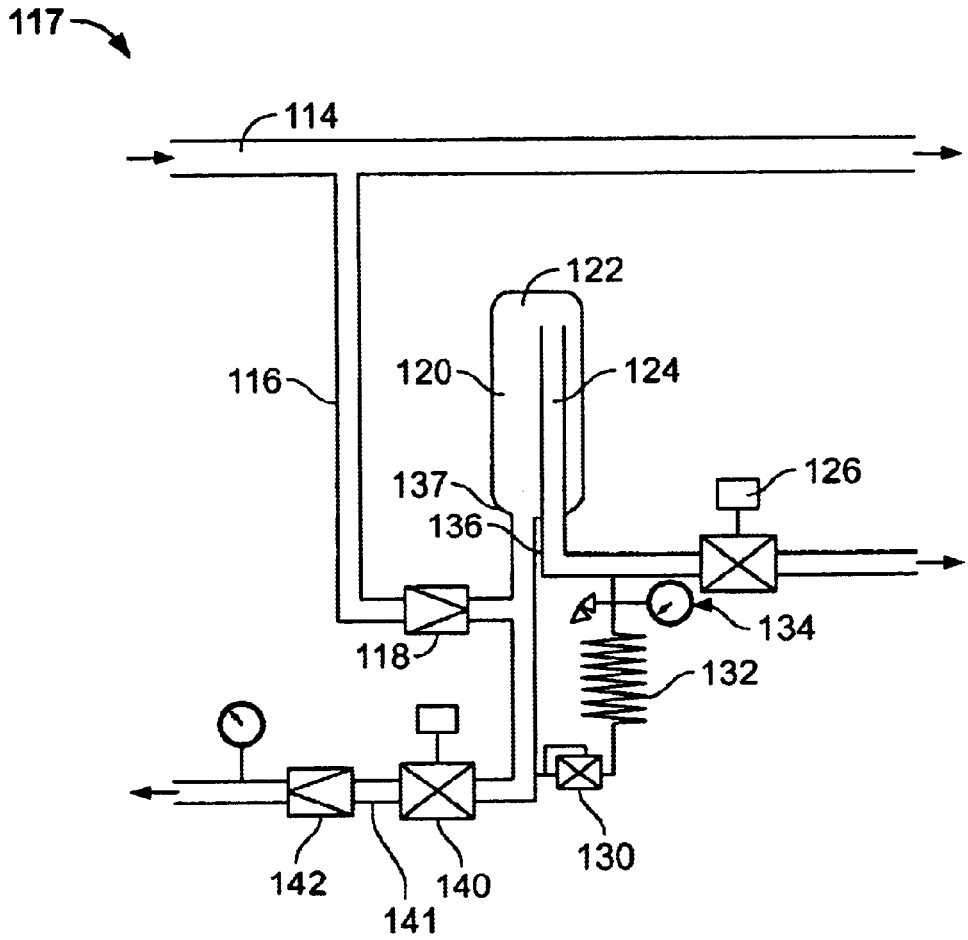
FIG. 2 is a schematic diagram of a second embodiment of the pressure pod cryogenic fluid expander system of the present invention.

FIG. 2 illustrates a second embodiment of the cryogenic expander of the present invention. Liquid cryogen, such as nitrogen, from a liquid storage source (not shown) enters the system via line 114 by gravity or other means. The liquid cryogen travels in line 114 to a use device, such as a food freezer (not shown), or travels through line 116 to the cryogenic expander system, indicated in general at 117. More specifically, the liquid cryogen travels in line 116 and through feed check valve 118 before entering line 136 to the pressure pod 120 of system 117. As with the system of FIG. 1, the pressure pod 120 may optionally be surrounded by insulation or jacketed. In addition, the system of FIG. 2 may be constructed/configured as a module and used to retrofit existing liquid dispensing systems.

Initially, an automated valve, such as regulator or economizer valve 130, and gas dispense valve 140, which also preferably is automated, are closed. As a result, the entering liquid cryogen is forced to travel through line 136 into the pressure pod 120. Initially, liquid dispense valve 126 is open and the liquid cryogen flows through the pressure pod 120, out line 124 and through the liquid dispense valve 126 to the use device.

When it is desired to expand the liquid cryogen to convert it to a cryogenic gas, the liquid dispense valve 126 is closed. As a result, the liquid cryogen collects in the pressure pod 120. Once the pressure pod 120 is full, the pressure therein increases so that additional liquid from line 114 is prevented from entering by feed check valve 118.

The pressure of the liquid cryogen in the pressure pod 120 gradually increases due to the slow warming of the liquid cryogen therein by ambient heat. Once the pressure of the liquid cryogen in the pressure pod 120 increases to a first predetermined level, the regulator valve 130 opens. The liquid cryogen flows through line 136 from the liquid side 137 of the pressure pod and through the regulator valve 130 to pressure building coil or heat exchanger 132. The heat exchanger 132 vaporizes the liquid cryogen. The vaporized liquid cryogen is directed to the head space 122 of the pressure pod 120 via line 124 so that the pressure therein increases. As a result, additional liquid is forced from the pod 120 to the vaporizer 132, is vaporized, and then returned to the pod.

Dispense valve 140 is set to open at a second predetermined level that is sufficiently above the operational pressure of the system gas storage tank (not shown). When this pressure is reached, the dispense valve 140 opens allowing the vaporized cryogen to travel to the gas storage tank through gas dispense line 141 and check valve 142. Once the pressure pod 120 is empty, valve 140 closes, valve 126 opens and liquid once again enters pod 120 so that the pressure building cycle may be repeated.

While the preferred embodiments of the invention have been shown and described, it will be apparent to those skilled in the art that changes and modification may be made therein without departing from the spirit of the invention.

What is claimed is:

1. A system for converting liquid cryogen from a source into a pressurized cryogenic gas comprising:

a. a pressure pod in communication with the source so that liquid cryogen is received therefrom;

b. means for ambient heating of the liquid cryogen in the pressure pod;

c. a heat exchanger having in inlet and an outlet, both in communication with the pressure pod;

d. an automated valve in circuit between the inlet of the heat exchanger and the pressure pod, said automated valve set to open when the pressure within the pressure pod exceeds a first predetermined level due to ambient heating of the liquid cryogen therein;

whereby pressurized cryogen gas is produced within the pressure pod by ambient heating of the liquid cryogen therein and vaporization of the liquid cryogen by the heat exchanger when a pressure within the pressure pod exceeds the first predetermined level.

2. The system of claim 1 wherein said pressure pod inch-ides a liquid side and further comprising a vaporizer in communication with the liquid side of the pressure pod, said vaporizer receiving pressurized liquid cryogen from the pressure pod and producing pressurized cryogenic gas therefrom.

3. The system of claim 2 further comprising a gas storage tank in communication with the vaporizer so that the pressurized cryogenic gas from the vaporizer may be stored in the gas storage tank.

4. The system of claim 2 further comprising a dispense valve in circuit between the liquid side of the pressure pod and the vaporizer, said dispense valve being automated and set to open when the pressure in the pressure pod exceeds a second predetermined level that is higher than said first predetermined level.

5. The system of claim 1 wherein the automated valve is an economizer valve.

6. The system of claim 1 wherein said pressure pod is insulated.

7. The system of claim 1 wherein the inlet of the heat exchanger communicates with the liquid side of the pressure pod and the outlet of the heat exchanger communicates with the head space of the pressure pod.

8. The system of claim 1 wherein said pressure pod include an inlet and further comprising a feed valve in communication with the inlet of the pressure pod, said feed valve adapted to communicate with the liquid cryogen source so that said feed valve dictates the amount of liquid cryogen received by the pressure pod.

9. The system of claim 8 further comprising a condenser in communication with the feed valve, said condenser adapted to communicate with the liquid cryogen source.

10. The system of claim 1 further comprising a gas dispense line and a dispense valve in circuit with the gas dispense line, said dispense valve automated when the pressure in said pressure pod exceeds a second predetermined level that is higher than the first predetermined level.

11. A system for converting a liquid cryogen into a pressurized cryogenic gas comprising:

a. a storage tank containing a supply of the liquid cryogen;

b. a pressure pod in communication with the storage tank so that liquid cryogen is received therefrom;

c. means for ambient heating of the liquid cryogen in the pressure pod;

d. an automated valve in communication with the pressure pod, said automated valve opening when a pressure within the pressure pod exceeds a first predetermined level due to ambient heating of the liquid cryogen therein; and e. a heat exchanger having an inlet in communication with the automated valve and an outlet in communication with the pressure pod, said heat exchanger receiving liquid cryogen from the pressure pod through the automated valve when the pressure within the pressure pod exceeds the first predetermined level so that cryogenic gas is produced and directed to the pressure pod.

12. The system of claim 11 wherein said pressure pod includes a liquid side and further comprising a vaporizer in communication with the liquid side of the pressure pod with a dispense valve in circuit there between, said dispense valve being automated and set to open when the pressure in the pressure pod exceeds a second predetermined level that is hither than said first predetermined level and said vaporizer receiving pressurized liquid cryogen from the pressure pod when the dispense valve is open and producing pressurized cryogenic gas therefrom.

13. The system of claim 12 further comprising a gas storage tank in communication with the vaporizer so that the pressurized cryogenic gas from the vaporizer may be stored in the gas storage tank.

14. The system of claim 11 wherein the automated valve is an economizer valve.

15. The system of claim 11 wherein said pressure pod is insulated.

16. The system of claim 11 further comprising a feed valve in circuit between the storage tank and the pressure pod) said feed valve dictating the amount of liquid cryogen received by the pressure pod.

17. The system of claim 11 further comprising a condenser in circuit between the feed valve and the storage tank.

18. The system of claim 11 further comprising a gas dispense line and a dispense valve in circuit with the gas dispense line, said dispense valve automated when the pressure in said pressure pod exceeds a second predetermined level that is higher than the first predetermined level.

19. A method of converting a liquid cryogen into a pressurized cryogenic gas comprising the steps of:

a. providing a pressure pod and a heat exchanger;

b. filling the pressure pod with liquid cryogen;

c. warming the liquid cryogen in the pressure pod with ambient heat;

d. monitoring a pressure of the liquid cryogen in the pressure pod as it is warmed with ambient heat;

e. vaporizing liquid cryogen from the pressure pod in the heat exchanger when the pressure within the pressure pod exceeds a first predetermined level; and f. directing the vaporized cryogen back to the pressure pod.

20. The method of claim 19 further comprising the steps of:

g. pressurizing the pressure pod with the vaporized cryogen of step f;

h. directing liquid cryogen forced out of the pressure pod as a result of step g. to a vaporizer; and i. vaporizing the liquid cryogen in the vaporizer so that pressurized cryogenic gas is produced.

* * * * *

UNITED STATES PATENT AND TRADEMARK OFFICE

CERTIFICATE OF CORRECTION

PATENT NO. : 6,786,053 B2
DATED : September 7, 2004
INVENTOR(S) : Paul Drube

It is certified that error appears in the above-identified patent and that said Letters Patent is hereby corrected as shown below:

Column 5,
Line 49, delete “inch ides” and insert therefor -- includes --

Column 6,
Line 6, delete “include” and insert therefor -- includes --
Line 45, delete “hither” and insert therefor -- higher --
Line 59, delete “pod)” and insert therefor -- pod --
Line 61, delete “the system of claim 11” and insert therefor -- the system of claim 16 --

Signed and Sealed this

Twenty-second Day of February, 2005

JON W. DUDAS
*Director of the United States Patent and Trademark Office*